US007530573B2

(12) United States Patent
Matilla et al.

(10) Patent No.: US 7,530,573 B2
(45) Date of Patent: May 12, 2009

(54) MEMORY AND ASSEMBLY GAME

(75) Inventors: Kimberly V. Matilla, Venice, CA (US); Benjamin Blagg, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 422 days.

(21) Appl. No.: 11/435,161

(22) Filed: May 15, 2006

(65) Prior Publication Data

US 2006/0290055 A1 Dec. 28, 2006

Related U.S. Application Data

(60) Provisional application No. 60/687,388, filed on Jun. 3, 2005.

(51) Int. Cl.
*A63F 9/12* (2006.01)

(52) U.S. Cl. ..... 273/276; 273/273; 273/288; 273/290; 273/308; 273/294

(58) Field of Classification Search ..... 273/276, 273/273, 288, 290, 308, 294
See application file for complete search history.

(56) References Cited

U.S. PATENT DOCUMENTS

| | | | | |
|---|---|---|---|---|
| 1,591,554 | A | 7/1926 | Guion | |
| 2,506,184 | A * | 5/1950 | Twining | 273/276 |
| 3,126,667 | A | 3/1964 | Rainbow | |
| 3,170,695 | A | 2/1965 | Pirko | |
| 3,178,185 | A | 4/1965 | Ardis | |
| 3,394,935 | A | 7/1968 | Beauchaine | |
| 3,468,540 | A * | 9/1969 | Mulligan | 273/256 |
| 3,583,706 | A | 6/1971 | Glass et al. | |
| 3,677,548 | A | 7/1972 | Hincz | |
| 3,738,659 | A * | 6/1973 | Partridge | 273/246 |
| 3,817,531 | A * | 6/1974 | King et al. | 273/243 |
| 3,863,918 | A | 2/1975 | Kramer | |
| 3,876,206 | A | 4/1975 | Moura | |
| 3,937,472 | A | 2/1976 | Rice | |
| 4,201,388 | A * | 5/1980 | Cantelon | 273/251 |
| 4,852,878 | A | 8/1989 | Merrill | |
| 4,948,146 | A | 8/1990 | Snyder et al. | |
| 4,950,912 | A * | 8/1990 | Goldfarb et al. | 273/249 |
| 4,979,324 | A * | 12/1990 | Rehtmeyer et al. | 40/490 |
| 5,062,637 | A | 11/1991 | Bianchi | |
| 5,149,098 | A | 9/1992 | Bianchi | |
| 5,190,296 | A | 3/1993 | Sainsbury | |

(Continued)

OTHER PUBLICATIONS

Memory Game Rules, http:web.archive.org/web/19970607191604/http:www.eduplace.com/ss/act/rules.html(Houghton Mifflin), Jun. 7, 1997.

(Continued)

*Primary Examiner*—Benjamin H Layno
(74) *Attorney, Agent, or Firm*—Kolisch Hartwell, PC

(57) ABSTRACT

A game is provided including cards and puzzle components. The cards may include collection cards, assembly cards, and action-altering cards that may affect assembly or manipulation of the puzzle components. The players work together to complete assembly of the puzzle or another joint task, such as matching of the cards. Consequently, the players are encouraged to cooperate as a team towards a common goal. The game also provides participants with an opportunity to practice their memorization, matching, and assembly skills.

13 Claims, 4 Drawing Sheets

U.S. PATENT DOCUMENTS

| | | | |
|---|---|---|---|
| 5,282,632 | A | 2/1994 | Allen et al. |
| 5,316,309 | A | 5/1994 | Takeshi |
| 5,390,935 | A | 2/1995 | Wilkins |
| 5,407,201 | A | 4/1995 | Whitehurst |
| 5,411,271 | A | 5/1995 | Mirando |
| 5,520,387 | A | 5/1996 | Snow |
| 5,520,395 | A | 5/1996 | Mondello |
| 6,746,017 | B2 | 6/2004 | Yu et al. |
| 2005/0056999 | A1 | 3/2005 | Roemer et al. |

OTHER PUBLICATIONS

International Search Report from International Application No. PCT/US2006/18926, mailed Sep. 14, 2007.

* cited by examiner

MEMORY AND ASSEMBLY GAME

CROSS-REFERENCE TO RELATED APPLICATIONS

This application claims priority under 35 U.S.C. 119(e) to U.S. Provisional Patent Application No. 60/687,388 entitled "MEMORY AND CONSTRUCTION GAME," filed Jun. 3, 2005, the disclosure of which is incorporated herein by reference.

BACKGROUND

Memory is a well-known children's game in which children match cards or tiles to collect pairs. Although the game may be exciting for children and improves their memorization skills, it encourages competition between players.

Examples of board games incorporating puzzles or other assembly or manipulation tasks are disclosed in U.S. Pat. Nos. 1,591,554, 3,126,667, 3,170,695, 3,178,185, 3,394,935, 3,583,706, 3,677,548, 3,863,918, 3,876,206, 3,937,472, 4,852,878, 5,062,637, 5,149,098, 5,190,296, 5,282,632, 5,316,309, 5,411,271, and 6,746,017, the disclosures of which are incorporated herein by reference.

SUMMARY

The present disclosure relates generally to a memory and assembly, or construction, game, and more specifically to rules and apparatus for playing a memory and construction game in which multiple players attempt to match cards or tiles to obtain puzzle or toy components to assemble the puzzle or toy. The players typically work together as a team. By including a joint task, such as building a puzzle together, children learn to cooperate with one another toward a common goal. However, the game may also include competitive aspects.

The advantages of the disclosed memory and construction game may be understood more readily after a consideration of the drawings and the Detailed Description.

DETAILED DESCRIPTION AND BEST MODE

Figure 1:
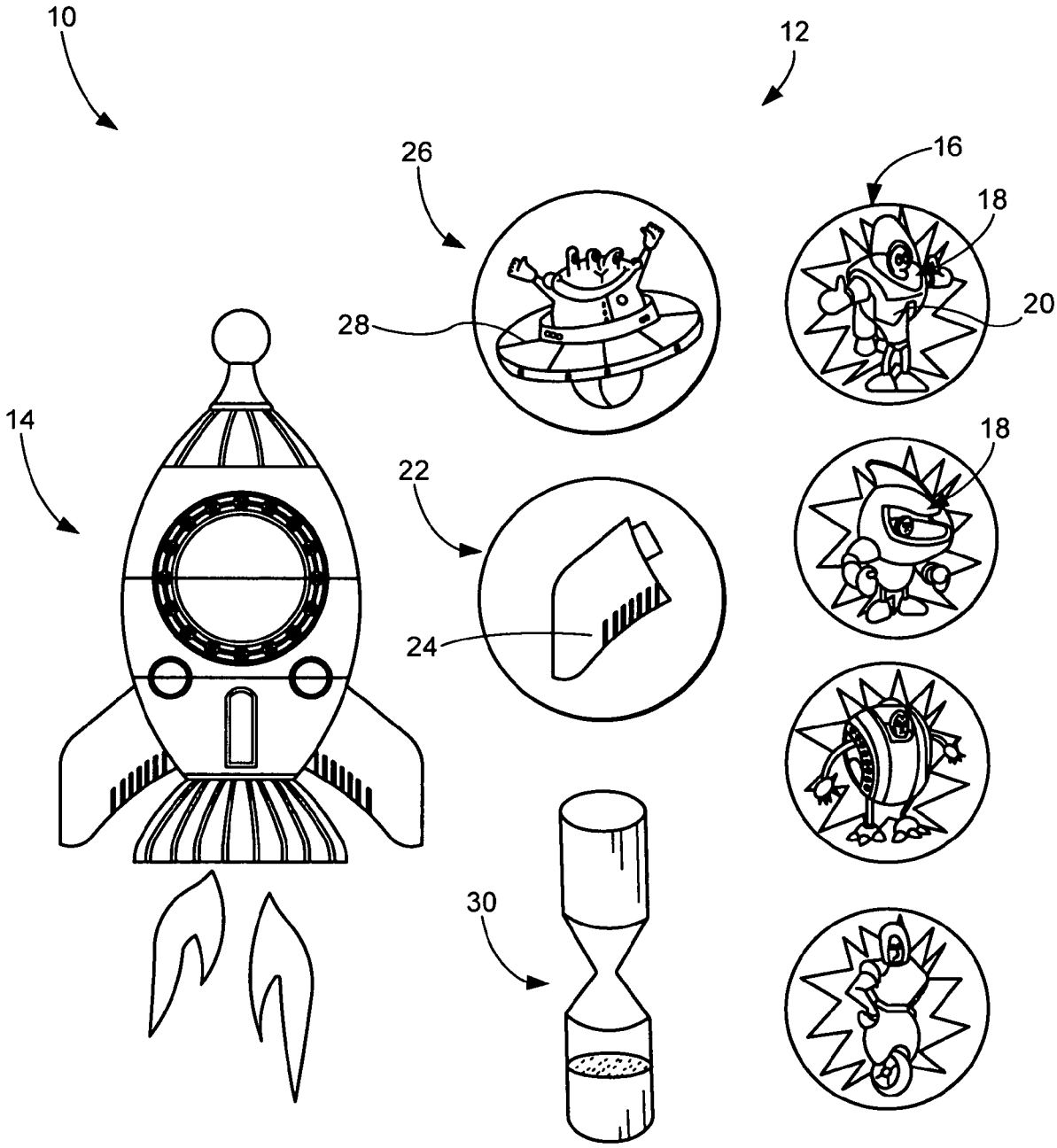
FIG. 1 illustrates game components including an assembled puzzle and cards.

The present disclosure provides rules and apparatus for playing a team-based memory and construction game, indicated generally at 10 in FIG. 1. The game uses cards or tiles 12 that bear indicia that indicate available play progression. A puzzle or toy 14 may be assembled based on the players' progress as indicated by the cards. The players work together to complete assembly of the puzzle or another joint task, such as matching of the cards. Consequently, the players are encouraged to cooperate as a team towards a common goal. The game also provides participants with an opportunity to practice their memorization, matching, and assembly skills.

As illustrated in FIG. 1, game 10 includes cards 12, each bearing various indicia. The indicia may be used to divide cards 12 into a variety of subgroups. For example, collection cards 16 may be provided and marked with collection indicia 18. Collection indicia 18 may be text or graphics. As shown in FIG. 1, collection indicia may depict images of astronauts 20. The indicia on collection cards 16 may correspond to indicia on other cards or tiles to form matching sub-groups. Although a matching sub-group may consist of any number of cards, typically the cards may be matched in pairs.

It should be appreciated that the complexity of the game may be altered by the number of cards required to form a match and the relationships between the indicia that allow matching to occur. For example, players may be required to match three or more cards having the same picture, color, or pattern, or may have to match one or more cards bearing a picture with one or more cards that have text describing a trait of the corresponding picture, etc.

In some versions of the game, collection cards 16 may be matched without effect on the puzzle or toy components. In other versions, matched collection cards may indicate a particular action that may be performed with respect to a puzzle or toy component. For example, once a set of collection cards is matched, a puzzle or toy component may be obtained and combined with previously obtained components. The player may choose the order in which to assemble the components and obtain his or her choice of components. Alternatively, the order of assembly and the particular puzzle component to be acquired may be indicated by the cards.

Allowing the player to choose the order of assembly of puzzle 14 may increase the complexity of the game as a successful order of assembly may not be readily apparent. For example, if the puzzle or toy is three-dimensional then some components may need to be assembled to provide a base structure upon which the remaining components are coupled. The multiple puzzle components may be adapted to be acquired as determined by card indicia and coupled together to form a complete puzzle. The indicia may include instructions regarding which puzzle component to acquire or instructions regarding how to couple the puzzle components previously acquired.

Cards 12 may include assembly cards 22 with assembly indicia 24 that may instruct a player regarding which puzzle component to acquire or how to manipulate previously acquired puzzle components. As depicted in the exemplary game of FIG. 1, assembly indicia 24 may indicate a particular puzzle component, such as a fin, to acquire and assemble with other acquired components, when possible.

Action-altering cards 26 may have action-altering indicia 28 that indicate a particular action a player is to take. The action may be related to collection cards 16 or to puzzle 14. For example, the game may include at least one action-altering card having action-altering indicia indicating that a portion of the puzzle is to be disassembled. The action-altering cards may instruct a player to alter puzzle 14 in other ways or may instruct a player to return a set of matched collection cards to a pile of unmatched cards.

The game may include a timer 30, against which the players race to perform a task, such as to complete the puzzle, or to match all sub-groups of collection cards 16. Alternatively or additionally, an action-altering card 26, which bears action-altering indicia 28, may signal the end of the game.

Figure 2:
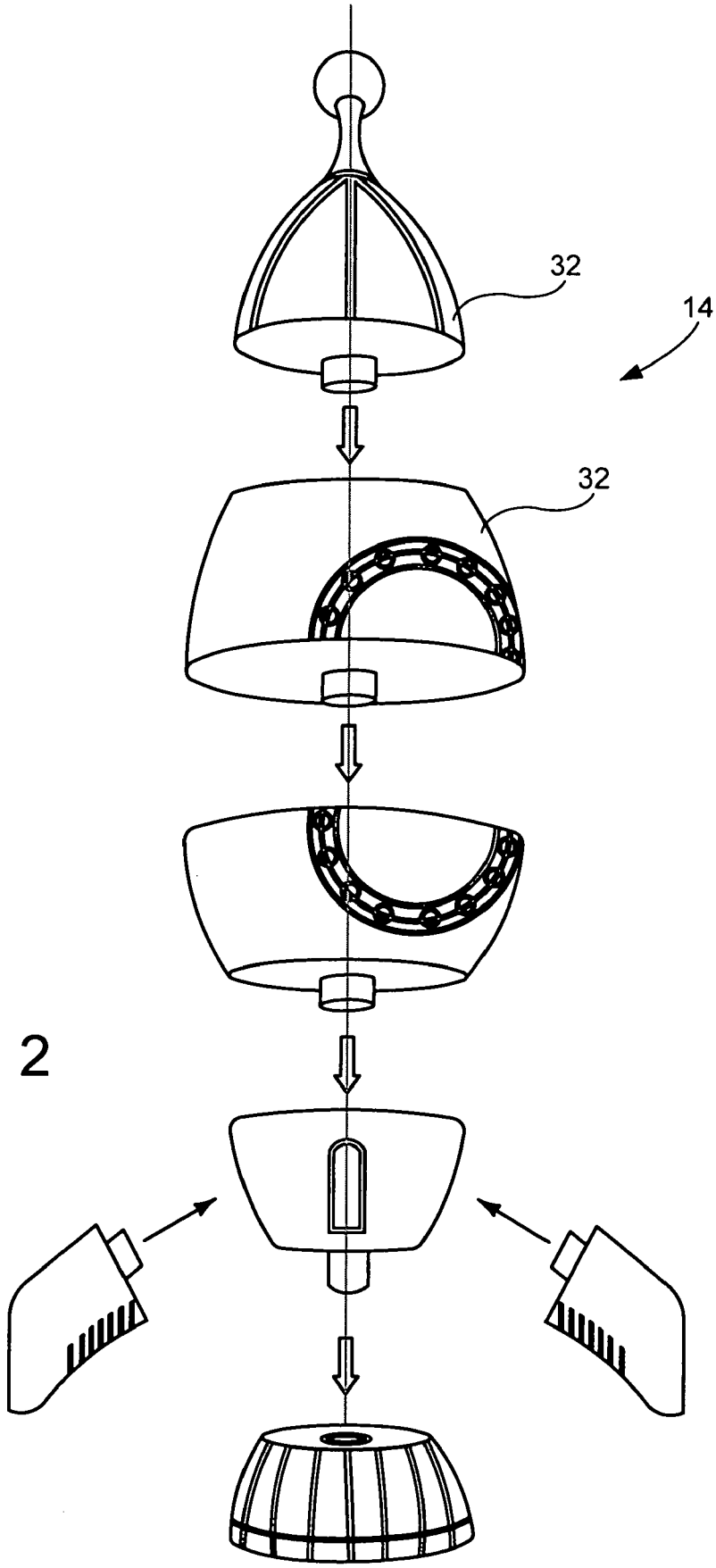
FIG. 2 is an exploded view of the puzzle of FIG. 1.
Figure 3A:
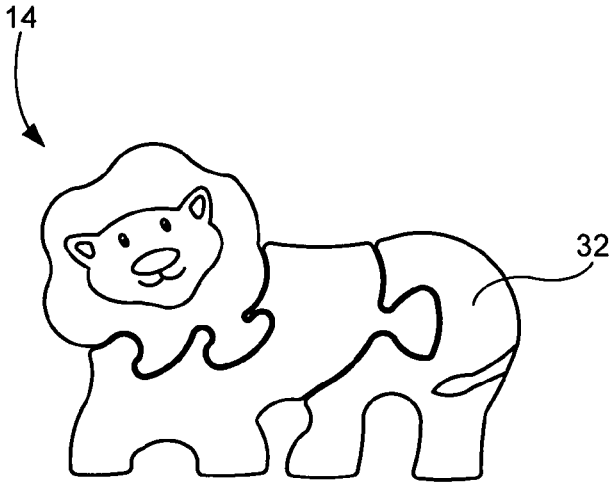
FIG. 3A illustrates an exemplary puzzle configuration in the form of a two-dimensional animal.
Figure 3B:
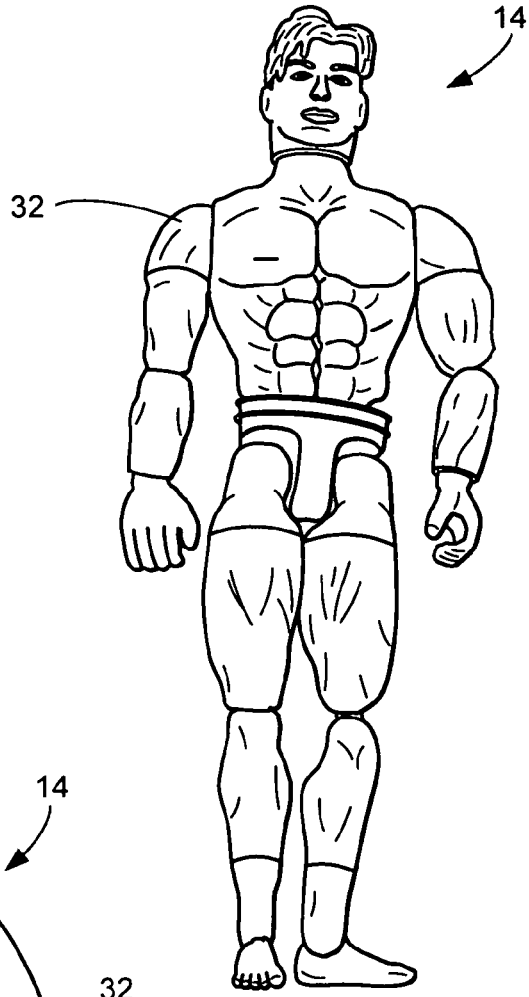
FIG. 3B illustrates an exemplary puzzle configuration in the form of a three-dimensional action figure.
Figure 3C:
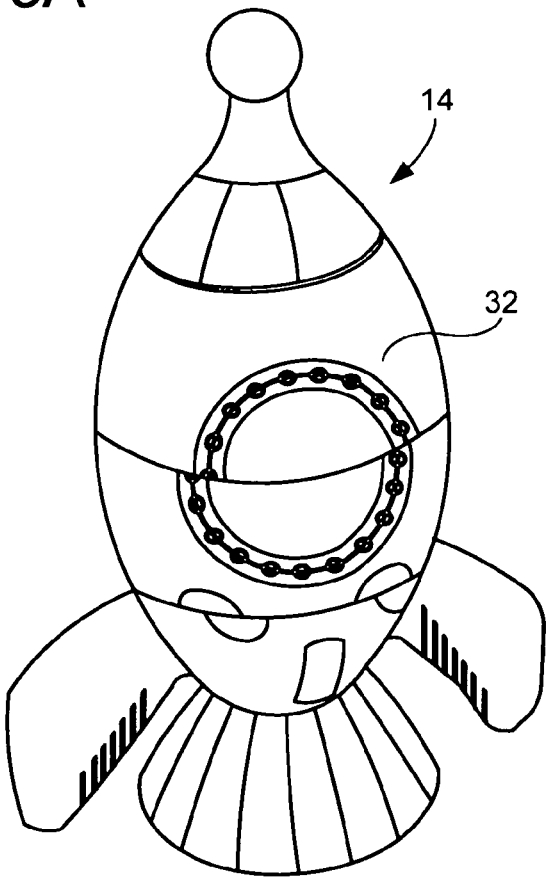
FIG. 3C illustrates an exemplary puzzle configuration in the form of a three-dimensional spaceship.

Puzzle 14 may be a two-dimensional puzzle, such as a jigsaw puzzle, or a three-dimensional puzzle. The puzzle may consist of separate components 32 that are assembled or disassembled during game play, as shown in FIG. 2, or may consist of components that are manipulated during game play to transform the puzzle from one configuration to another. As illustrated in FIGS. 3A-C, puzzle 14 may take a variety of forms, such as action figures, vehicles, animals, or other toys.

The game may end when a predetermined game task is completed. For example, the game may continue until all of the puzzle components are coupled together or all of the collection cards are matched. If players are divided into two or more teams, the winning team may be determined based on which team has earned the most points, such as by collecting the most sets of matching collection cards. In some versions of the game, teams work on different tasks. For example, one team may try to assemble the puzzle while the other team attempts to collect all of the sets of collection cards.

Figure 4:
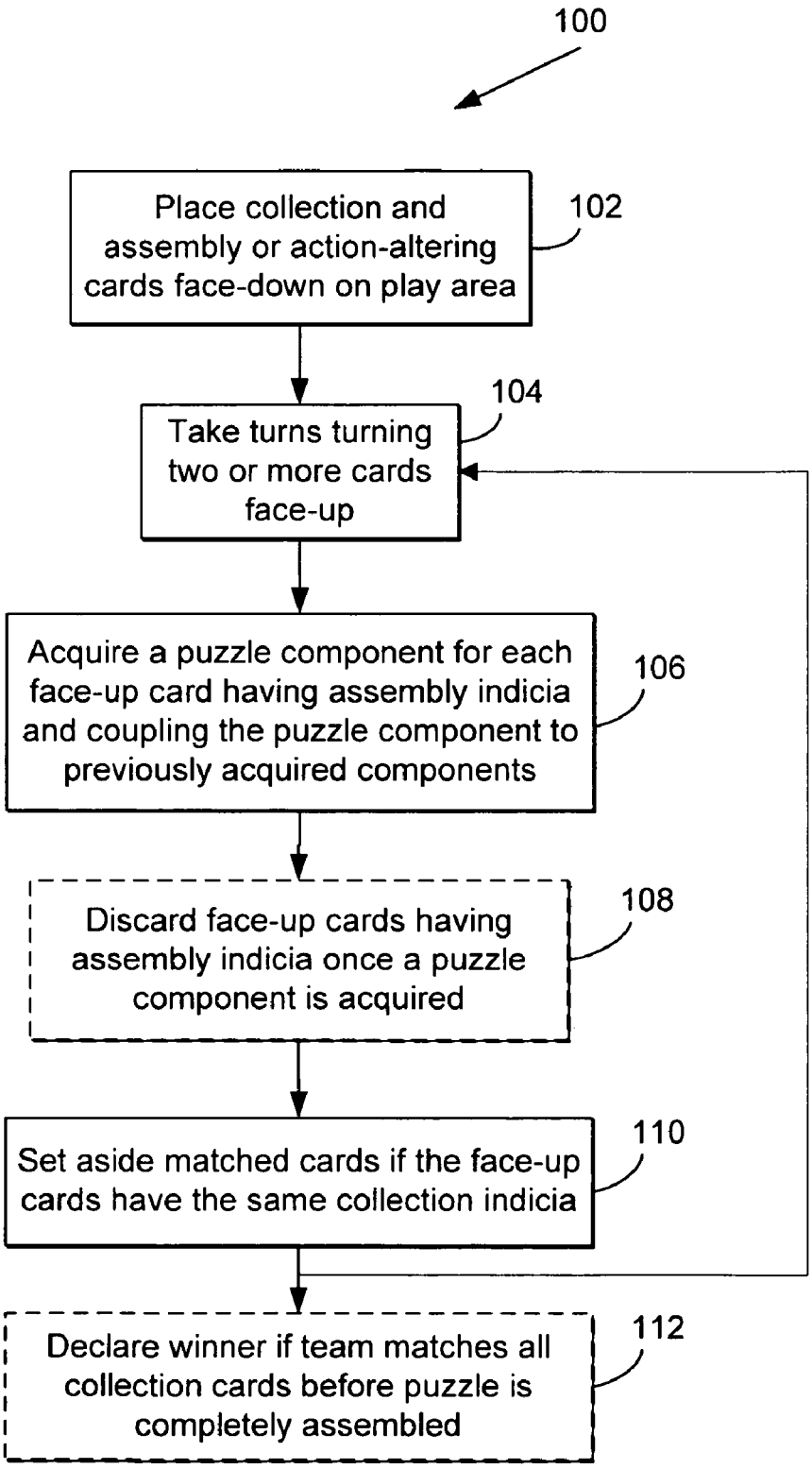
FIG. 4 is a flow chart illustrating an exemplary method of game play using the game of FIG. 1.

The game may be played by one or more teams. In one method of playing a team-based game 100, such as that illustrated in FIG. 4, players are provided with multiple sets of collection cards having collection indicia adapted to provide easy recognition and matching of the collection cards, multiple assembly cards having assembly indicia, and puzzle components. The cards may be placed face-down on a play area 102. The cards may be placed randomly on the play area or in an organized configuration.

Players may take turns turning two or more cards face-up 104. A puzzle component may be acquired for each face-up card having assembly indicia. The acquired puzzle component may be coupled to puzzle components previously acquired by any player 106. Each face-up card having assembly indicia may be discarded once a puzzle component is acquired 108. If the face-up cards have the same collection indicia, the matched cards may be set aside 110. If the face-up cards do not have the same collection indicia, a player may turn the cards face-down again. This process may be repeated until all of the puzzle components are coupled together or all of the collection cards are matched.

In some versions of the game, multiple action-altering cards having action-altering indicia may be placed face-down with the collection and assembly cards. For each face-up card having action-altering indicia, a player may be required to uncouple a portion of the puzzle. A winning team may be declared if the sets of collection cards are all matched before the puzzle is completed 112.

In another method of playing the game, players are provided with collection cards and action-altering cards. Assembly cards may be further included, or may be conceptually combined with the action-altering cards. Players may take turns turning cards face-up and setting aside matched collection cards. A player who turns up matching collecting cards may choose and assemble a puzzle component, either in accordance with instructions on the cards or at the player's choice. Players may be required to perform other tasks for each non-collection indicia that is showing. For example, players may have to obtain or disassemble a puzzle component for each action-altering indicia that is visible depending on the altered action indicated on the card.

In the example configuration shown in FIG. 1, players take on the role of robot astronauts who must work together to assemble their spaceship to return home. A figurative Martian works against the players, through a Martian action-altering card, to disassemble the spaceship. When a player matches astronaut cards, a component may be added to the spaceship. But if a player draws the Martian card then a component must be removed from the spaceship. The Martian card may then be discarded. To win the game, the spaceship must be completely assembled before the final Martian tile is overturned. Alternatively, spaceship components may be assembled only when the Martian card is drawn. Players work together to collect all of the astronauts before the spaceship leaves without them. In such a version of the game, the collection cards may need to all be matched before the spaceship is assembled to win the game.

In a version of the above-described game intended for two to four preschool age children, such as three years old and above, the toy is an easy to assemble three-dimensional puzzle made of wood, or other suitable material, as shown in FIGS. 1-3. Cooperation may be a part of the game as the players are a team of robot astronauts who are trapped on a foreign planet. They work together to build their spaceship so they can return home even though a Martian is working against them. If the players make an astronaut match, they put a piece of the spaceship together; but if they turn over a Martian tile, they take a piece of the spaceship puzzle apart. An object of the game may be for the players to work together as a team to complete the spaceship puzzle by making matches using the cards. If the spaceship is finished before the last Martian tile is revealed the players win the game as a team. But if the last Martian tile is turned over before the spaceship is complete, the Martian wins.

An embodiment of the above-described game may include five two-dimensional or three-dimensional wood puzzle pieces and twenty-nine round two-and-a-half inch tiles, including twenty-four astronaut tiles and five Martian tiles, each having the same appearance when face-down. To play the game, all twenty-nine tiles are laid face down in two circles around a base component of the spaceship. The remaining four spaceship puzzle components are set to the side. On each player's turn, the player flips over two cards. If the cards match, the player may put a piece of the spaceship puzzle together. If the cards do not form a match, the cards may be flipped back over so they are face down. Play typically proceeds clockwise or in other ordered fashion among the players.

If a player turns over a Martian tile, that player must take a piece of the spaceship apart and put the tile off to the side. Typically, it remains out of play until the end of the game. The game continues until either the last Martian tile is turned over or the spaceship is complete.

Although the present invention has been shown and described with reference to the foregoing operational principles and preferred embodiments, it will be apparent to those skilled in the art that various changes in form and detail can be made without departing from the spirit and scope of the invention. The present invention is intended to embrace all such alternatives, modifications and variances. The subject matter of the present invention includes all novel and non-obvious combinations and subcombinations of the various elements, features, functions and/or properties disclosed herein. Inventions embodied in various combinations and subcombinations of features, functions, elements, and/or properties may be claimed through presentation of claims in a subsequent application.

We claim:

1. A method of playing a team-based game for one or more teams, comprising:

providing multiple sets of collection cards having collection indicia adapted to provide recognition and matching of the collection cards, wherein the collection cards of each set each include the same collection indicia, multiple assembly cards having assembly indicia, and puzzle components;

placing the collection and assembly cards face-down on a play area;

turning two or more cards face-up;

acquiring a puzzle component for each face-up card having assembly indicia;

setting aside matched cards if the face-up cards have the same collection indicia; and repeating the turning, acquiring, and setting steps until a predetermined game task is complete, wherein the acquiring step further includes coupling the puzzle component to puzzle components previously acquired by any player.

2. The method of claim 1, further comprising:

turning the two or more face-up cards face-down if the face-up cards do not have the same collection indicia.

3. The method of claim 1, further comprising:

discarding each face-up card having assembly indicia after a puzzle component is acquired.

4. The method of claim 1, further comprising:

providing multiple action-altering cards having action-altering indicia;

placing the action-altering cards face-down with the collection and assembly cards; and uncoupling a component of the puzzle for each face-up card having action-altering indicia.

5. The method of claim 1, further comprising:

declaring a winning team if the sets of collection cards are all matched before the puzzle is completed, wherein selection of the winning team is based on the quantity of matched sets of collection cards.

6. The method of claim 1, wherein the assembly indicia include instructions regarding which puzzle component to acquire.

7. The method of claim 6, wherein the assembly indicia include instructions regarding how to couple the puzzle component to puzzle components previously acquired.

8. A method of playing a construction game including multiple sets of collection cards having collection indicia, wherein the collection cards of each set each include the dame collection indicia, multiple assembly cards having assembly indicia, multiple action-altering cards having action-altering indicia, and puzzle components, the method comprising:

placing the collection cards, the assembly cards, and the action-altering cards face-down on a play area;

turning two or more cards face-up;

acquiring a puzzle component for each face-up card having assembly indicia and coupling the puzzle component to any puzzle components previously acquired by a player;

setting aside matched cards if the face-up cards have the same collection indicia; and uncoupling a component of the puzzle for each face-up card having action-altering indicia and discarding each face-up card having action-altering indicia.

9. The method of claim 8, further comprising:

repeating the turning, acquiring, setting, and uncoupling steps until a predetermined game task is completed, and discarding each face-up card having assembly indicia.

10. The method of claim 8, further comprising:

declaring a winner if the sets of collection cards are all matched before the puzzle is completed, wherein selection of the winning team is based on the quantity of matched sets of collection cards.

11. The method of claim 8, wherein the assembly indicia include instructions regarding which puzzle component to acquire.

12. The method of claim 8, wherein the assembly indicia include instructions regarding how to couple the puzzle component to puzzle components previously acquired.

13. The method of claim 8, further comprising:

turning the face-up cards face-down if the face-up cards do not have the same collection indicia.

* * * * *